US008316488B2

(12) United States Patent
Rojas

(10) Patent No.: US 8,316,488 B2
(45) Date of Patent: Nov. 27, 2012

(54) CONTOURED BODY SUPPORT PILLOW

(75) Inventor: Ana C. Rojas, Ventura, CA (US)

(73) Assignee: Ana C. Rojas, Ventura, CA (US)

( * ) Notice: Subject to any disclaimer, the term of this patent is extended or adjusted under 35 U.S.C. 154(b) by 0 days.

(21) Appl. No.: 13/108,131

(22) Filed: May 16, 2011

(65) Prior Publication Data

US 2012/0011655 A1 Jan. 19, 2012

Related U.S. Application Data

(60) Provisional application No. 61/364,075, filed on Jul. 14, 2010.

(51) Int. Cl.
*A47G 9/10* (2006.01)
*A47C 20/00* (2006.01)

(52) U.S. Cl. ..... 5/637; 5/640; 5/645; 297/393; 297/397

(58) Field of Classification Search ..... 5/636, 637, 5/640, 644, 645; 297/397, 398, 393
See application file for complete search history.

(56) References Cited

U.S. PATENT DOCUMENTS

| | | | | |
|---|---|---|---|---|
| 3,667,074 | A * | 6/1972 | Emery | 5/636 |
| 4,550,458 | A * | 11/1985 | Fiore | 5/637 |
| 4,679,263 | A * | 7/1987 | Honer | 5/640 |
| 5,544,378 | A * | 8/1996 | Chow | 5/644 |
| 6,006,381 | A * | 12/1999 | Tandrup | 5/655 |
| 6,532,611 | B1 * | 3/2003 | Day | 5/636 |
| 7,644,990 | B2 * | 1/2010 | Pearson | 297/393 |
| 2003/0226207 | A1 * | 12/2003 | Lowenthal | 5/644 |
| 2005/0155152 | A1 * | 7/2005 | Coats et al. | 5/636 |
| 2009/0307846 | A1 * | 12/2009 | Eura et al. | 5/636 |

* cited by examiner

*Primary Examiner* — Michael Trettel
(74) *Attorney, Agent, or Firm* — SoCal IP Law Group LLP; Steven C. Sereboff; Jonathan Pearce

(57) ABSTRACT

There is disclosed a support pillow. The support pillow includes a body with a head rest and a neck rest along with a pair of arms extending outward and forward from the body to thereby surround the sides of the head and neck of a user. The support pillow may also incorporate a storage bag for compressing and storing the body and arms of the support pillow.

19 Claims, 12 Drawing Sheets

CONTOURED BODY SUPPORT PILLOW

RELATED APPLICATION INFORMATION

This patent claims priority from U.S. Provisional Application No. 61/364,075 filed Jul. 14, 2010 entitled "Contoured Body Support Pillow" by the inventor named in the present application, which is hereby incorporated by reference.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to a contoured body support pillow.

2. Description of the Related Art

Enhanced personal comfort for the head, neck and chin while sitting is a goal that a number of products have attempted to address. Support pillows of various types have been employed in the hope of addressing this goal. The support pillow has been and continues to be desired for both therapy and comfort.

These support pillows are typically employed to support the head and neck while the user is in a sitting position. Providing such support eases the burden on the spinal column and allows the muscles of the neck and shoulders to relax. Consumers often purchase a number of pillows in search of adequate support.

Many support pillows are available. However, these pillows tend to be uncomfortable, too large, cumbersome, expensive, difficult to store or carry, or prone to functional inadequacy. In addition, many support pillows lack adequate head and neck support. Many of the most portable support pillows are ineffective for their primary function of supporting the head, neck and chin in an upright position.

A U-shaped pillow is the most common style of travel and support pillow available. These pillows provide some comfort, but provide limited side and neck support. Other pillows provide more comfort or support, but sacrifice portability as a result. Pillow designs include inflatable devices, traditional neck braces and memory foam devices.

In addition, typical pillows tend not to retain the desired position while the user is sitting. Typically, the only source of maintaining placement for most pillows is the pillow's relationship with the user's head or neck. This enables the pillow to move and to, thus, requires readjustment.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element in the figure with the corresponding most significant digit.

DETAILED DESCRIPTION

Figure 1:
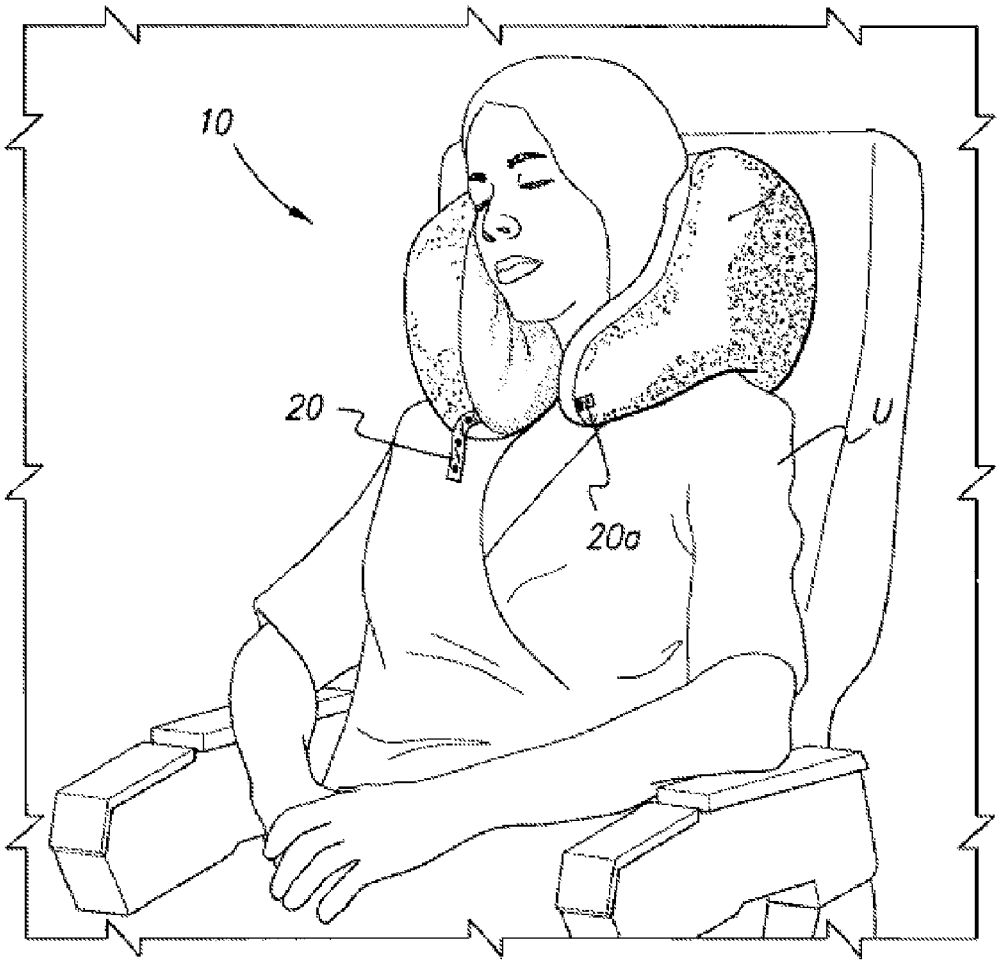
FIG. 1 is an environmental, perspective view of a support pillow.

Referring now to FIG. 1, an environmental, perspective view of a support pillow is shown. The support pillow 10 may be used to support the neck, head and chin of a user U. The support pillow 10 may be used when the user is in a seated, reclined or supine position. The support pillow 10 may also incorporate a strap 20 and at least one fastener 20*a* to ensure that it remains around the neck of the user U.

Figure 2:
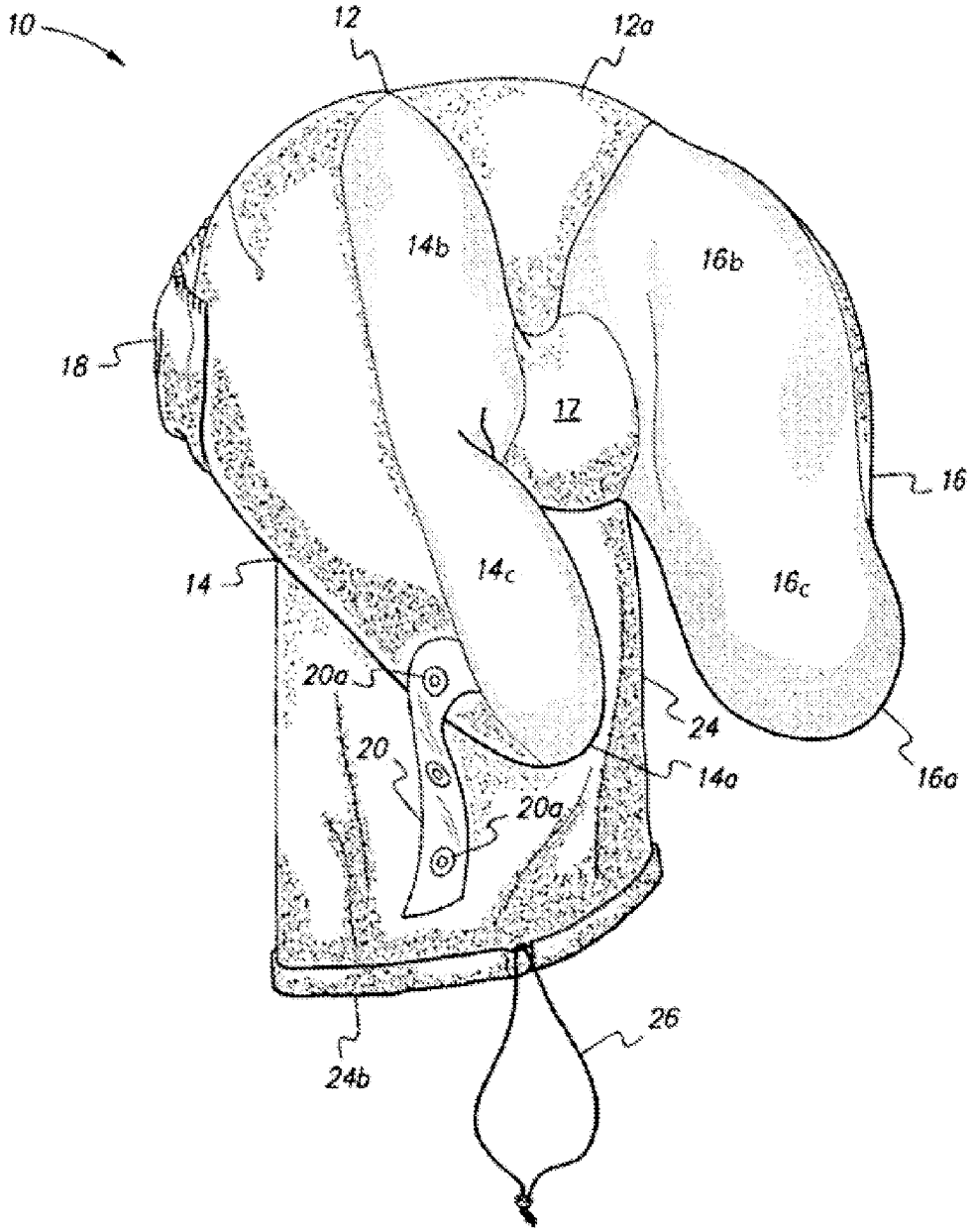
FIG. 2 is a front, perspective view of a support pillow in a deployed position.
Figure 3:
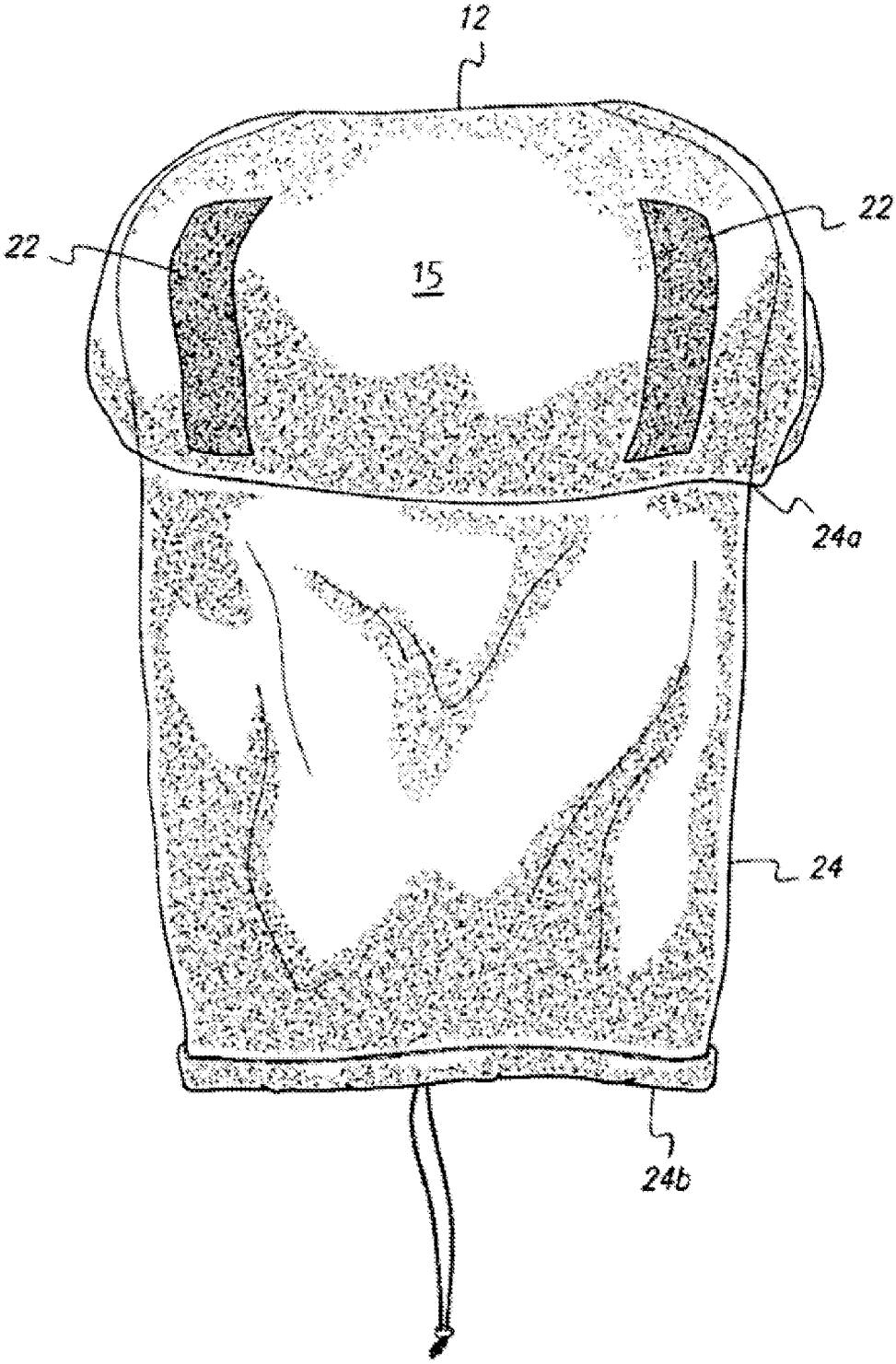
FIG. 3 is a rear view of the support pillow of FIG. 2.

Turning now to FIGS. 2-3, a front, perspective view and a rear view, respectively, of a support pillow 10 are shown. The support pillow 10 has a central body 12, made up of a head rest 12*a*, a neck rest 17 and a backing 15 (FIG. 3). The central body 12 is connected to a left arm 14 and a right arm 16, both connected to and extending from the central body 12. The arms 14, 16 have bulbous upper portions 14*b*, 16*b* and tubular lower portions 14*c*, 16*c*. The arms 14 and 16 terminate in respective free ends 14*a*, 16*a*. The arms 14 and 16 substantially encircle the head and neck of a user when the support pillow 10 is in use. The support pillow 10 also may include one or more small pockets 18 on its exterior surface.

The support pillow 10 has a front face that may be made from a fabric soft to the touch, flexible or otherwise agreeable to a user's skin.

The central body 12 may be made of a fabric that is more durable and stain-resistant. The central body 12 or the backing 15 may be composed in whole or in part of anti-slip materials so as to ensure that the support pillow 10 stays in place as the environment changes or the user moves his or her head and neck.

The head rest 12*a* is a u-shaped or triangular section of fabric attached to the upper portions 14*b*, 16*b* of the arms 14, 16 on either side, to the neck rest 17 at the base of the head rest 12*a* and it is backed by the backing 15. The head rest 12*a* may be made of a thin, elastic material suitable for moisture-wicking and for comfortable non-cushioned placement of a user's head. The backing 15 may be a u-shaped or triangular portion of fabric of the same shape and material as the head rest 12*a*. Alternatively, the backing 15 may cover an area larger than that of the head rest 12*a*.

The head rest 12*a* may be designed so as to allow the user's head to rest against the head rest of the seat, the bed or pillow that the user's head is resting upon. The head rest 12*a* provides connective material of one or two layers of fabric to maintain the physical shape of the support pillow, but may be otherwise unfilled with fill material or filled very minimally. In this way, the head rest 12*a* allows the user's head to rest most comfortably against an existing head support and does not force the user's head into an uncomfortable forward-leaning or incline position.

The neck rest 17 is substantially tubular and backed by the backing 15. The neck rest 17 connects the lower part of the upper portions 14*b*, 16*b* of the arms 14, 16 and is connected to the lower portion of the head rest 12*a*. The neck rest 17 may be filled with fill material similar to that of the central body 12 and arms 14 and 16 of the support pillow 10. The neck rest 17 provides support to a user's neck and ensures that the user's head does not slip deep into the support pillow 10. The neck rest 17 may be substantially tubular.

One or more small pockets, such as pocket 18, may be affixed to the outer surface of the arms 14, 16 or the backing 15. Pocket 18 may be used to store small items for personal use (earplugs, earphones, mp3 players, audio devices, recording devices, etc.).

A strap 20 may be attached near the end 14*a* of arm 14. Mating fasteners 20*a* such as snap fasteners, may be provided on the strap 20 and the opposing end 16*a* of arm 16 to fasten the ends 14*a* and 16*a* together under the chin of a user. In another embodiment, shown in FIG. 10, two straps may be affixed to the ends 14*a* and 16*a* and a hook and loop strap may be used to connect the two under a chin of a user. Additional fastening elements may be used in order to fasten the ends 14*a* and 16*a* together under the chin of the user in order to aid in maintaining the position of the support pillow 10 on a user's neck when in use.

Hook and loop fasteners 22 (FIG. 3) may also be positioned on the rear outer surface of central body 12 in order to allow a user to attach additional pieces to the support pillow 10. The additional pieces may include anti-slip elements or straps used to attach the support pillow 10 to a seat or to compress the support pillow 10 for storage, either in the attached bag 24 or in a separate bag.

A storage bag 24 may be affixed below the support pillow 10 to the backing 15 and neck rest 17. The storage bag 24 may be affixed by sewing, hook and loop fasteners or may be a continuation of the fabric used for the backing 15 or neck rest 17, but with a sewn shut seam that also serves to terminate the base of the central body 12. The storage bag 24 may also include an open top 24*b* away from the central body 12. The open top 24*b* may include a drawstring 26 used to enclose the support pillow 10 in the storage bag 24 when not in use.

The storage bag 24 may include pockets on its exterior (in the position shown in FIG. 3, which becomes the interior when the storage bag 24 is in use). These pockets may be used to store items that will only be used when the support pillow 10 is in use. One or more pockets may also be included on the interior (in the position shown in FIG. 3, which becomes the exterior when the storage bag 24 is in use) to store items that will only be used when the support pillow 10 is not in use.

The support pillow 10 exterior may be natural or synthetic fiber or cloth, recycled or original material such as polyester, rubber, cotton, bamboo, rayon, lycra, lycra-like material, or hemp. The support pillow 10 fill material may be manufactured in whole or in part from natural or synthetic fiber, cloth, foam, cotton, poly-fill or Styrofoam beads. The support pillow 10 fill material may be fragrant or include deodorizing elements. The support pillow 10 fill material may also be or include air or other gases. In such case, the pillow 10 may incorporate an internal bladder or the support pillow 10 may, itself, be substantially air-tight. A combination of air or other gasses and fill material may also be used.

Figure 4:
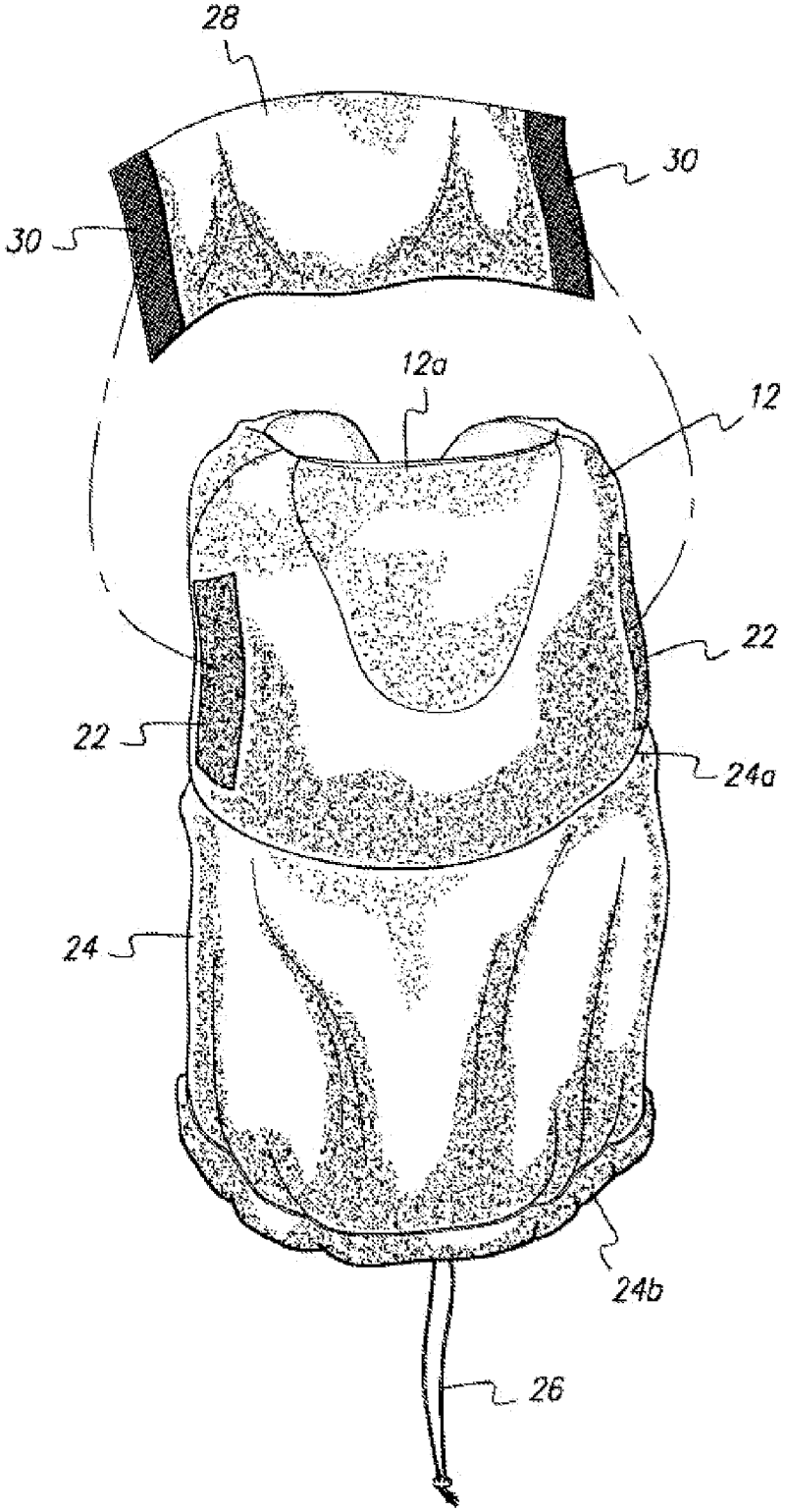
FIG. 4 is an exploded, perspective view showing the support pillow of FIG. 2 in the process of being stowed.

Turning now to FIG. 4, an exploded, perspective view showing the support pillow of FIG. 2 in the process of being stowed is shown. The head rest 12*a* stretches to enable the arms 14 and 16 (FIG. 2) to be folded toward one another.

The hook and loop fasteners 22 become stretched further from one another. Corresponding hook and loop fasteners 30 on a girdle 28 may be detached from the back of the central body 12, placed in front of the support pillow 10 and reattached to the hook and loop fasteners 22. In this way, the arms 14 and 16 (FIG. 2) are held together and compressed under the pressure provided by the girdle 28. The material inside the support pillow 10 is suitable to provide soft cushion for a user's head and to be sufficiently resilient to return to its normal size once the compression of the girdle 28 is removed. The compression enables a user to more easily place and store the support pillow 10 inside the storage bag 24.

The girdle 28 may be affixed to the back of the support pillow 10 with the same hook and loop fasteners 22 and 30 when not in use compressing the support pillow 10. The girdle 28 may include an anti-slip outer surface to maintain the support pillow 10 in a desired position relative to the user's neck when in use. The user's head provides backwards pressure to enable the anti-slip outer surface of the girdle 28 to engage the surface upon which the user's head is resting. The placement of the girdle 28 on the back also provides a convenient storage location when not being used to compress the support pillow 10 for storage The storage bag 24 may include a drawstring 26 at its open top 24*b* to aid a user in enclosing the storage bag 24 around the support pillow 10. Once the support pillow 10 is compressed, it may be placed inside the bag 24 and further enclosed using the drawstring 26.

The storage bag 24 may also function to stabilize the support pillow 10 when in use. The weight of the user's back bears against the storage bag 24, thereby aiding in maintaining the position of the support pillow 10. The storage bag 24 may also act as a barrier for undesirable dirt, bacteria or other residue that may be present on a seat back.

Figure 5:
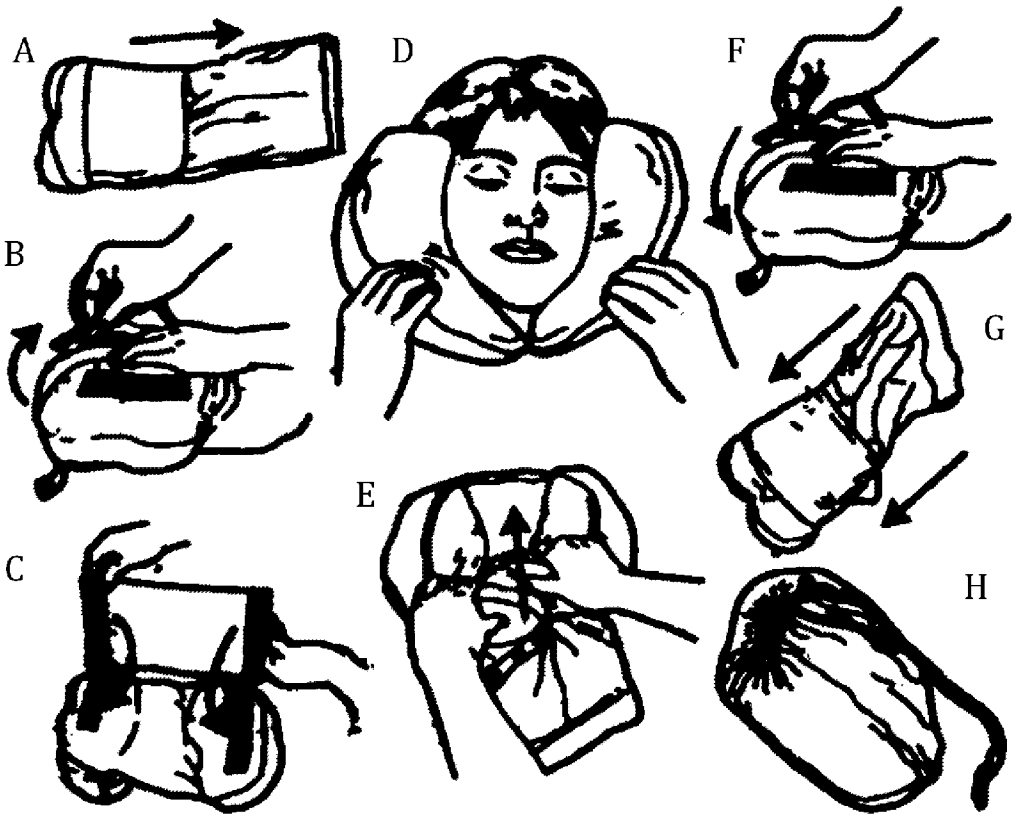
FIG. 5, made up of FIGS. 5A, 5B, 5C, 5D, 5E, 5F, 5G and 5H is a series of diagrams demonstrating how the pillow is taken out of and stored into the bag.

Turning now to FIG. 5, a series of diagrams demonstrating how the pillow is taken out of and stored into the bag is shown. In use, the support pillow 10 is first removed from the storage bag 24 by inverting the storage bag 24 over the body of the compressed support pillow 10 (FIG. 5A). Next, the girdle 28, used to compress the support pillow 10 is removed (FIG. 5B). Then, the hook and loop fasteners 30 of the girdle 28 are reaffixed to the hook and loop fasteners 22 on the back of the support pillow 10 (FIG. 5C). The user then places the support pillow 10 in the desired location behind and around the user's head for use.

To store the support pillow 10, the arms 14 and 16 are folded inwardly (FIG. 5E). Next, the girdle 28 is wrapped around the free ends 14A, 16*a* of the arms 14, 16, and the hook and loop fasteners 30 of the girdle 28 are mated with the hook and loop fasteners 22 on the rear surface of central body 12 to thereby compress the support pillow 10 (FIG. 5F). The storage bag 24 is then inverted over the compressed support pillow 10 (FIG. 5G). When complete, the storage bag 24 may be closed using the drawstring 26 (FIG. 5H).

Figure 6:
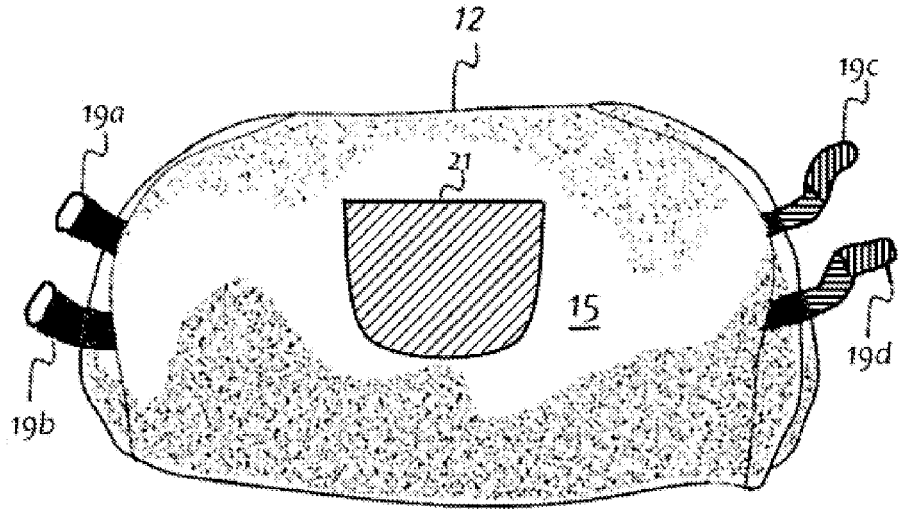
FIG. 6 is a rear view of the support pillow of FIG. 2 showing an alternative compression system for stowing.

Turning now to FIG. 6, a rear view of the support pillow of FIG. 2 showing an alternative compression system for stowing is shown. The backing 15 of the central body 12 incorporates the alternative system as a series of straps 19*a*, 19*b*, 19*c* and 19*d*. The straps 19*a* and 19*b* incorporate loops for use in looping through the straps 19*c* and 19*d*. The straps 19*c* and 19*d* may incorporate hook and loop fasteners so as to removeably self-affix when place through the straps 19*a* and 19*b*. In this way, the straps 19*a*, 19*b*, 19*c* and 19*d* may be used across the front of the support pillow 10 to compress the arms 14, 16 for storage. The backing 15 may also incorporate a portion of anti-slip material 21.

Figure 7:
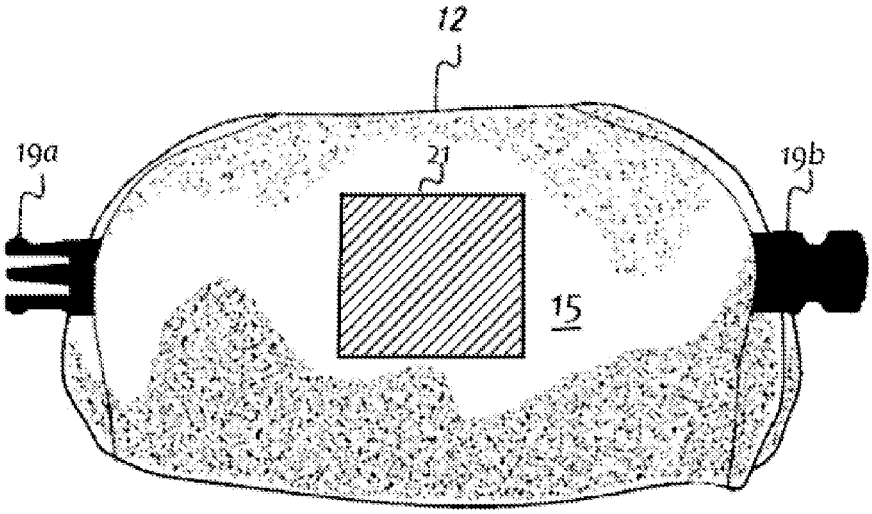
FIG. 7 is a rear view of the support pillow of FIG. 2 showing an alternative compression system for stowing.

Turning now to FIG. 7 a rear view of the support pillow of FIG. 2 showing an alternative compression system for stowing is shown. The backing 15 of the central body 12 in the embodiment shown in FIG. 7 include a pair of mated clips 19*a* and 19*b*. As with the hook and loop fasteners of FIG. 6, the clips 19*a* and 19*b* may be joined on the front of the support pillow 10 to thereby compress the arms 14 and 16 for storage. As with FIG. 6, the backing 15 may also incorporate a portion of anti-slip material 21.

Figure 8:
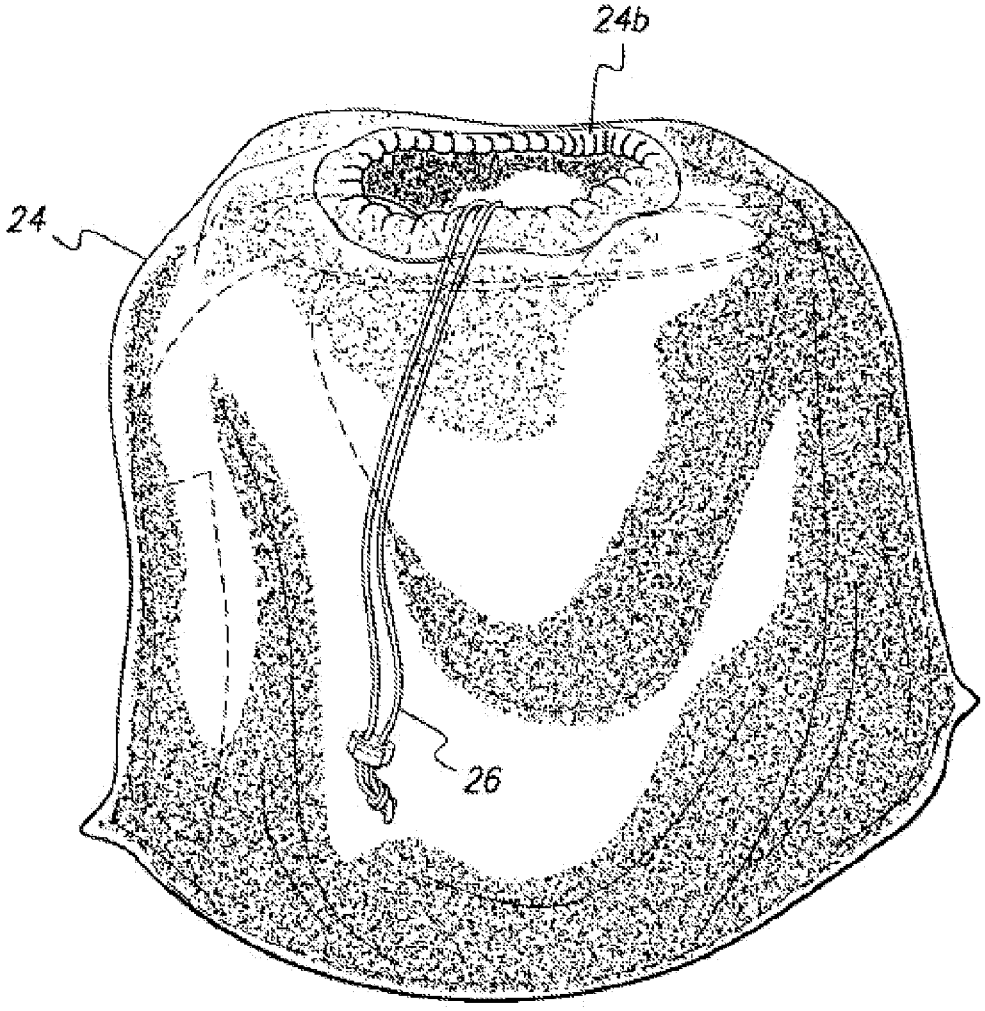
FIG. 8 is a perspective view of the support pillow of FIGS. 2 and 3 in its stowed position.

Turning now to FIG. 8, a perspective view of the support pillow of FIGS. 2 and 3 in its stowed position is shown. The support pillow 10 is stored inside the inverted storage bag 24. The support pillow 10 may be maintained inside the open top 24*b* of the storage bag 24 by using the drawstring 26 to close the open top 24*b* to a size smaller than that of the compressed support pillow 10. Inside the storage bag 24, the compressed support pillow 10 takes up less space than when in use. When in this shape, the support pillow 10 may also be used to provide lumbar support to a sitting individual.

Figure 9:
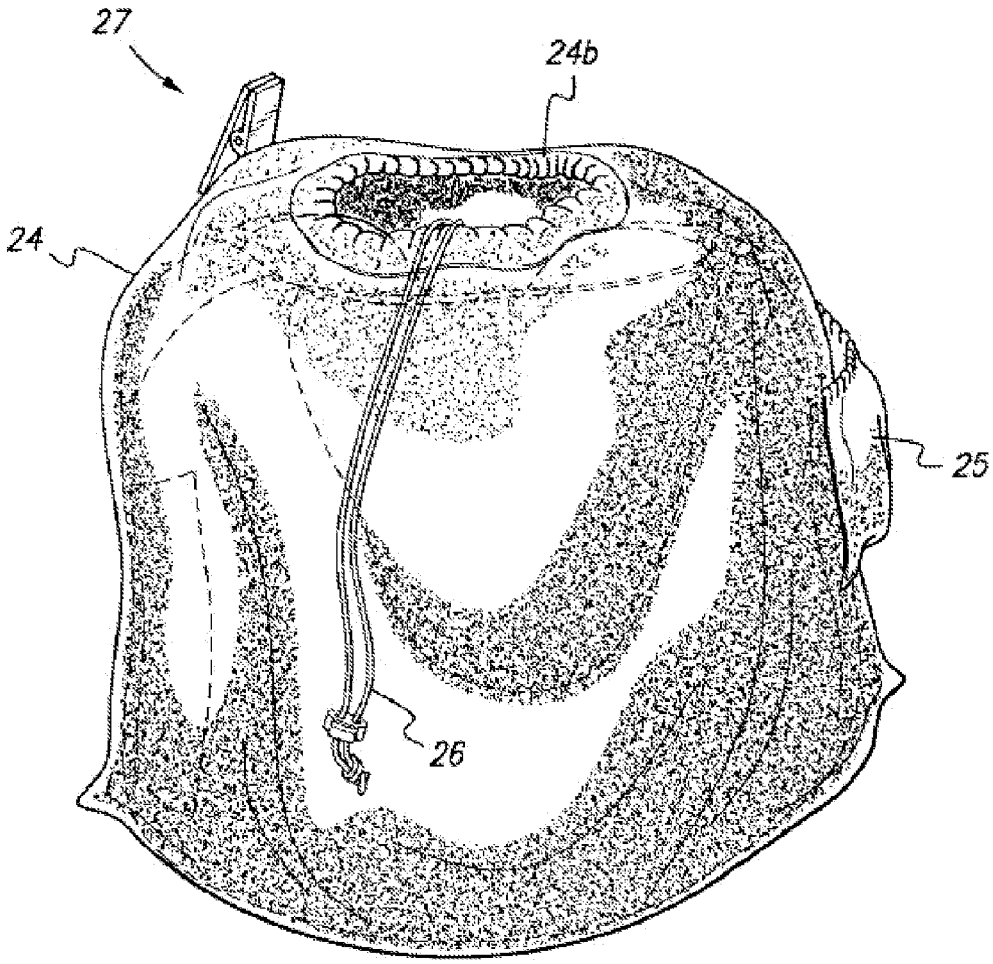
FIG. 9 is a perspective view of the support pillow of FIGS. 2 and 3 in a stowed position.

Turning now to FIG. 9, a perspective view of the support pillow of FIGS. 2 and 3 in its stowed position is shown. This alternative storage bag 24 incorporates an external pocket 25 and clip 27. The external pocket 25 may be used to store items, such as earplugs. The clip 27 may be used to attach the storage bag 24 to another item, a seat or bag for storage. The anti-slip outer surface of the girdle 28 may also serve to maintain the position of the compressed support pillow 10 while it is within the storage bag 24.

Figure 10:
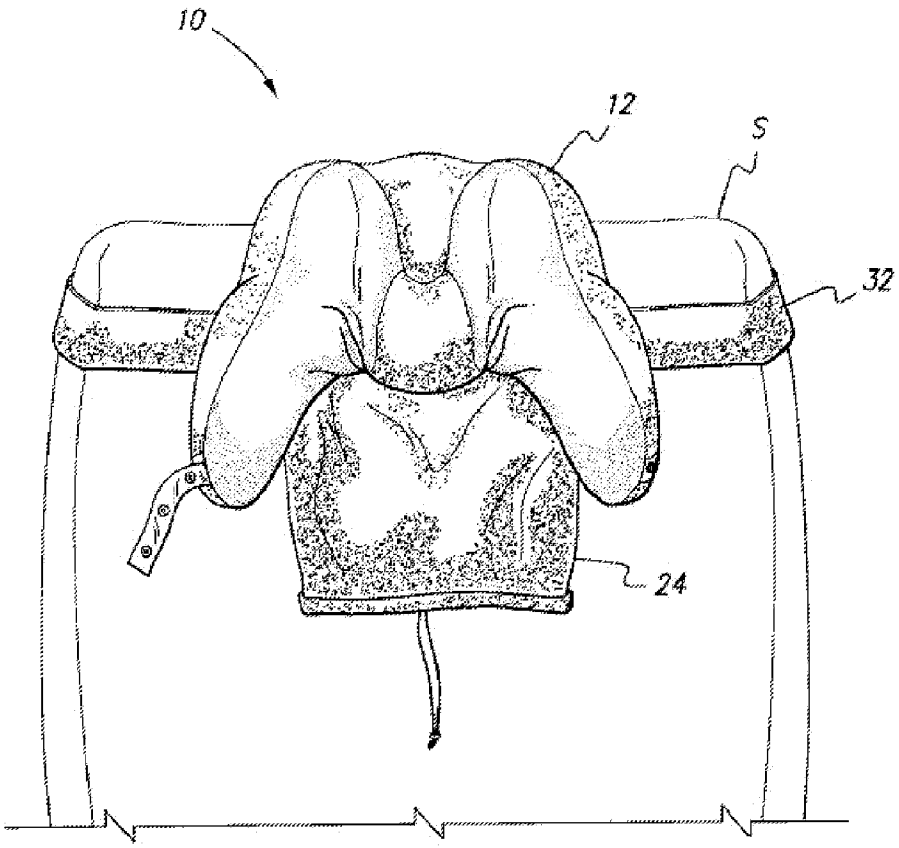
FIG. 10 is a front view of the support pillow of FIG. 2 with a first configuration of a strap used to secure the pillow to a seat.

Turning now to FIG. 10, a front view of the support pillow of FIG. 2 with a first configuration of a strap used to secure the pillow to a seat is shown. The support pillow 10 includes the central body 12 and storage bag 24. When used, the strap 32 may be permanently affixed to the back of the central body 12, may attach to the body using the hook and loop fasteners 22, clips, buckles or using some other method. In this configuration, the strap 32 is shown substantially parallel to the top of and encircling the seat S to which it is secured.

The strap 32 may be made entirely or in part from an elastic or otherwise stretchable, yet resilient material. Alternatively, the strap 32 may be resizable using a buckle or by doubling the strap 32 upon itself. A strap 32 may optionally be a part of the support pillow 10 or may be an accessory to the support pillow 10. When not in use, the strap 32 maybe stored along with the support pillow 10 in the storage bag 24. Or the pillow may be made with no strap to secure to the seat.

Figure 11:
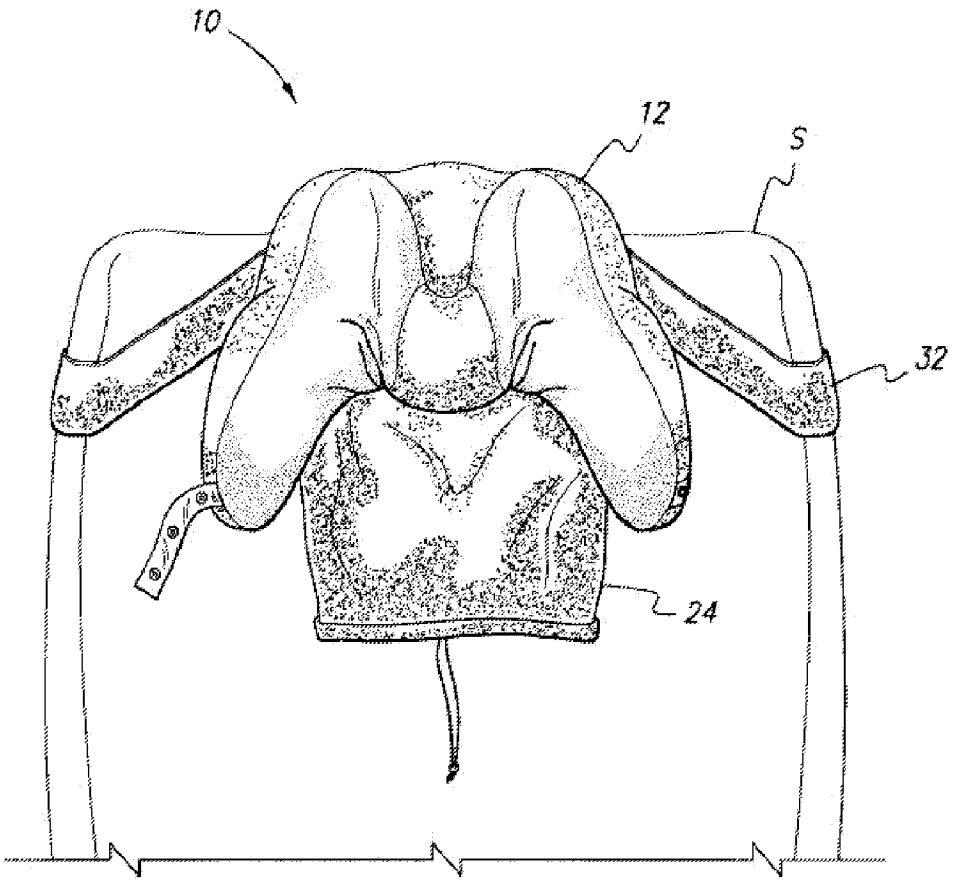
FIG. 11 is a front view of the support pillow of FIG. 2 with a second configuration of a strap used to secure the pillow to a seat.

FIG. 11 is a front view of the support pillow of FIG. 2 with a second configuration of a strap used to secure the pillow to a seat. The strap 32 in this configuration is angled at approximately a thirty degree angle upwards from the exterior of the seat S to the top of the seat S. This configuration enables the strap 32 to be connected around the exterior of the seat S and to attach over the top of the seat S. In this configuration, an additional portion of the strap S (not shown) may hang over the back of the seat S and attach to the strap 32 in the back of the seat S. This portion, when used, will prevent the support pillow 10 from slipping down on the seat S and may maintain the position of the support pillow 10 relative to the seat S. A third configuration is no strap at all.

Figure 12:
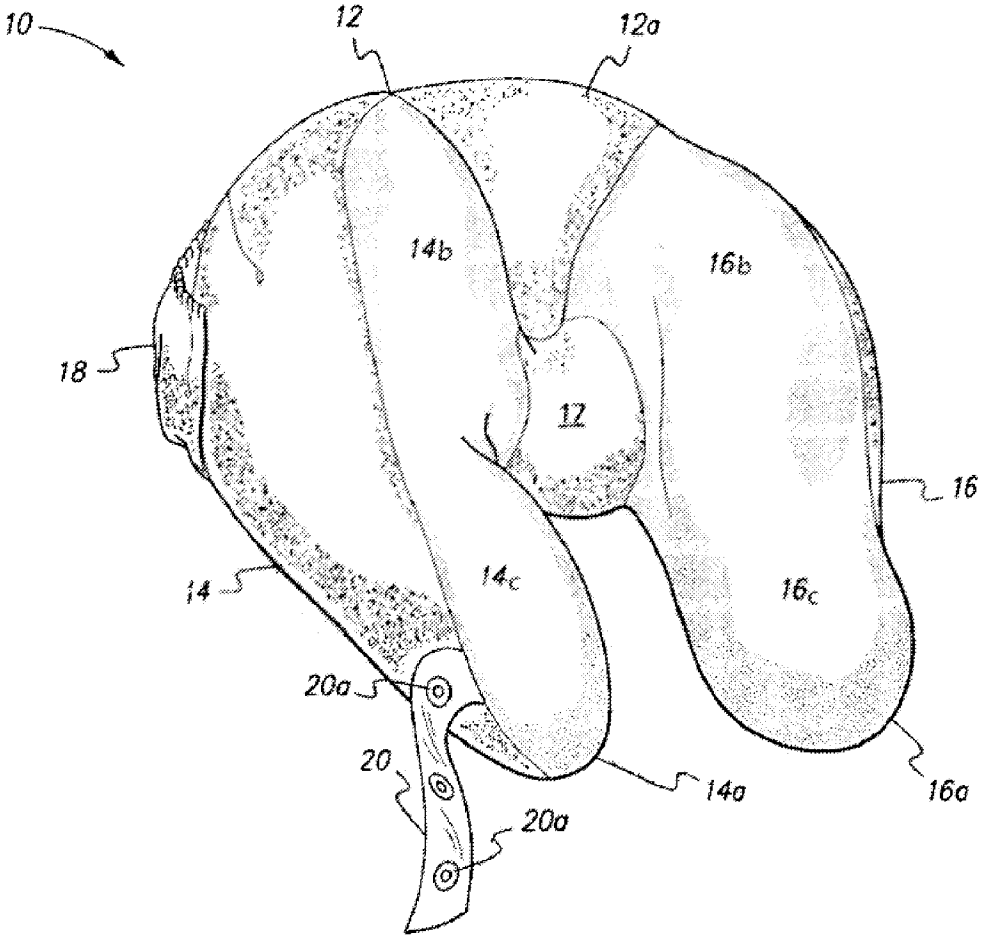
FIG. 12 is a front, perspective view of the pillow without the storage bag and including a strap.

Turning now to FIG. 12, a front view of the support pillow of FIG. 2 with a second configuration of a strap used to secure the pillow under the chin. This is the support pillow 10 of FIG. 2 with the central body 12, the head rest 12*a*, the arms 14 and 16, including the upper portions 14*b*, 16*b*, the lower portions 14*c*, 16*c* and the terminating in ends 14*a*, 16*a*, the neck rest 17 and the pocket 18 affixed to the exterior of the arm 14. The arm 14 may include a strap 20 with mating fasteners 20*a* such as snap-in buttons. If no storage bag 24 (FIG. 2) is attached to the support pillow 10, a separate storage bag may be provided.

Figure 13:
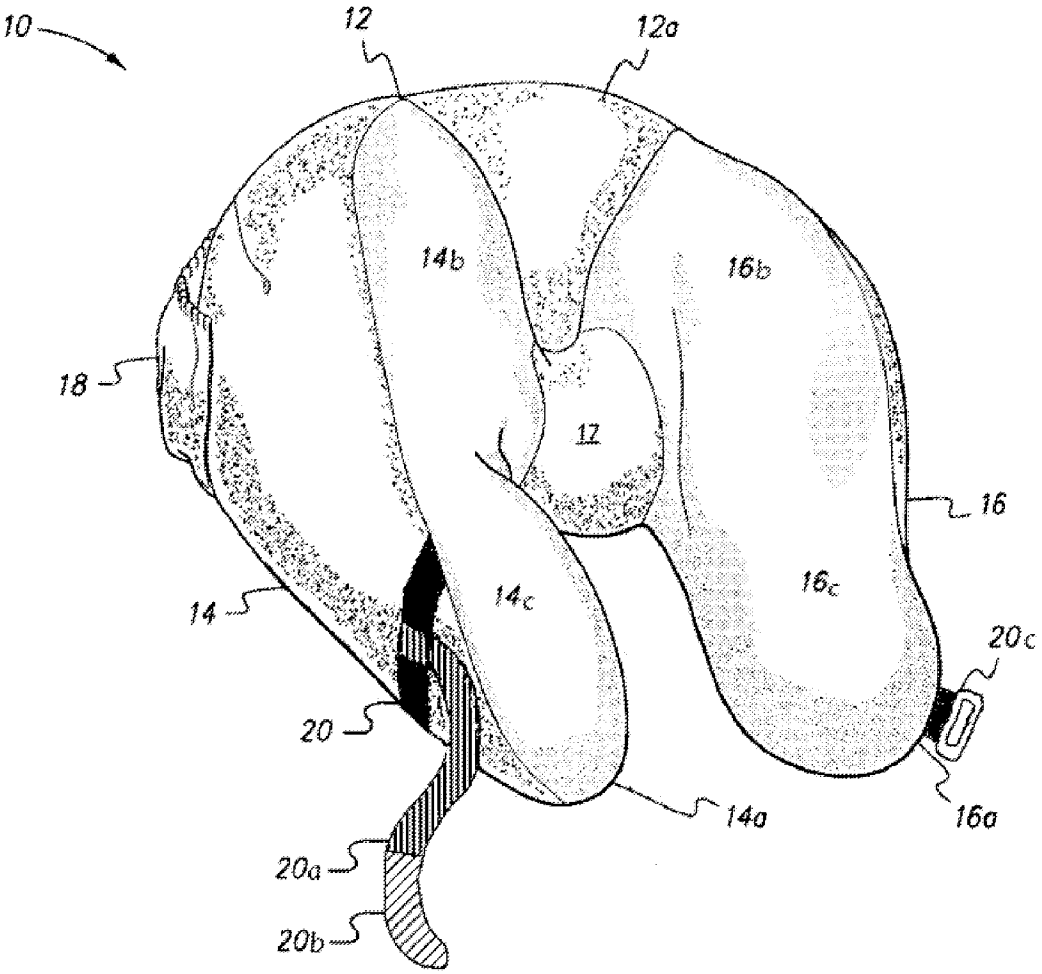
FIG. 13 is a front, perspective view of the pillow without the storage bag and including an alternative strap.

Turning now to FIG. 13, a front, perspective view of the pillow without the storage bag and including an alternative strap is shown. This is the same support pillow 10 of FIGS. 2 and 10 with the central body 12, the head rest 12*a*, the arms 14 and 16, including the upper portions 14*b*, 16*b*, the lower portions 14*c*, 16*c* and the terminating in ends 14*a*, 16*a*, the neck rest 17 and the pocket 18 affixed to the exterior of the arm 14. A storage bag 24 (FIG. 2) may not be attached, but may be separately provided.

The support pillow 10 arm 14 may include a different strap 20 than those shown in FIGS. 2 and 12. This strap 20 may be made of a pliable material and include hook and loop fasteners 20*a* and 20*b* that, when folded in upon themselves form a secure bond. The strap 20 may first be passed through a loop 20*c* on the end 16*a* of the arm 16. This loop may be made of plastic, or metal or may be another strap substantially similar to that provided by strap 20. Still other straps may be made using thread, rope, buckles, snaps, hooks, tethering or buttons. In some cases, a strap 20 may not be used at all.

CLOSING COMMENTS

Throughout this description, the embodiments and examples shown should be considered as exemplars, rather than limitations on the apparatus disclosed or claimed. Although many of the examples presented herein involve specific combinations of elements, it should be understood that those elements may be combined in other ways to accomplish the same objectives. Acts, elements and features discussed only in connection with one embodiment are not intended to be excluded from a similar role in other embodiments.

It is claimed:

1. A support pillow comprising:

a central body having a left side and a right side including a head rest and a neck rest, wherein the head rest is disposed above the neck rest, the head rest comprises a thin layer of compressible unfilled material for cradling a head of a user and the neck rest comprises a filled compressible tubular portion of the body immediately below the head rest for providing support to a neck and the head of a user;

a left arm and a right arm, both compressible, extending from respective sides of the central body and terminating in respective free ends, each arm having a larger, bulbous upper portion and a tubular, smaller lower portion, the arms for cradling and substantially encircling the head and the neck of the user and for ensuring that the head and the neck of the user remains in a substantially upright position; and a strap, affixed to at least one of the free ends, for causing the free ends to substantially abut.

2. The support pillow of claim 1 further comprising a storage bag for enclosing the body and the arms when compressed.

3. The support pillow of claim 1 wherein the strap retains the ends of the arms encircling the head and neck of the user.

4. The support pillow of claim 1 wherein the strap is comprised of a pliable material and includes at least one hook and loop fastener.

5. The support pillow of claim 1 wherein the exterior of the central body includes anti-slip material.

6. The support pillow of claim 5 wherein the anti-slip material is affixed to the exterior of a girdle that may be removed and used to compress the storage pillow for storage within the storage bag.

7. The support pillow of claim 5 wherein pressure applied by a user on the head rest engages the anti-slip material to assist in maintaining the support pillow in a desired position.

8. The support pillow of claim 1 wherein the storage bag extends from the central body downward such that the back of a user of the support pillow will rest against the storage bag when the support pillow is in use.

9. The support pillow of claim 1 including at least one pocket on the exterior of the central body.

10. The support pillow of claim 1 wherein the central body, the arms and the neck rest are filled with fill material.

11. A support pillow comprising:

a central body including a compressible head rest, a compressible neck rest and a backing, wherein the head rest is disposed above the neck rest, the head rest and neck rest are backed by the backing, and the head rest comprises a thin layer of unfilled material for cradling the head of a user, the neck rest comprises a filled portion of the body for providing support to a neck and a head of a user, and the backing comprising an enclosing material behind the head rest and neck rest;

a left arm and a right arm each extending from respective sides of the central body, the arms for cradling and substantially encircling the head and the neck of the user and for ensuring that the head and the neck of the user remain substantially in an upright position; and a storage bag permanently extending from the central body for enclosing the central body and the arms when the support pillow is compressed.

12. The support pillow of claim 11 wherein the storage bag extends downward from the body such that a back of the user of the support pillow will rest against the storage bag when the support pillow is in use.

13. The support pillow of claim 11 further comprising a strap permanently extending from at least one of the arms for causing the arms to become substantially adjacent to one another and to thereby substantially encircle the head and the neck of the user.

14. The support pillow of claim 13 wherein the strap includes one of a hook and loop fastener and a snap-in button.

15. The support pillow of claim 11 wherein the central body and the arms are filled with a fill material that is resilient when compressed for storage and provides support to the head and neck of the user when encircling the neck of the user.

16. The support pillow of claim 11 wherein the central body and the arms may be compressed and the storage bag is inverted to thereby enclose the central body and the arms of the support pillow for storage.

17. The support pillow of claim 11 wherein the backing includes anti-slip material for maintaining the position of the support pillow relative to a seat when in use.

18. The support pillow of claim 11 wherein the storage bag further comprises a drawstring.

19. A support pillow comprising:

a central body including a head rest, a neck rest and a backing, wherein the head rest disposed above the neck rest, the head rest and the neck rest are backed by the backing, the head rest comprises a thin layer of unfilled material for cradling the head of a user, the neck rest comprises a filled portion of the body for providing support to a head and a neck of a user, and the backing comprising an anti-slip material behind the head rest and neck rest;

a left and a right arm, each extending from respective sides of the central body and each comprising a bulbous upper portion and a lower tubular portion terminating in free ends, the arms for cradling and substantially encircling the head and the neck of the user and for ensuring that the head and the neck of the user remain substantially in an upright position; and a storage bag permanently attached to the central body for enclosing the central body and the arms when the support pillow is compressed, the storage bag extending downward such that a back of the user of the support pillow will rest against the storage bag when the support pillow is in use.

* * * * *